US006339915B1

(12) United States Patent
Bradbury

(10) Patent No.: US 6,339,915 B1
(45) Date of Patent: Jan. 22, 2002

(54) SPURS

(76) Inventor: Jayne Elizabeth Bradbury, Rose Cottage, Lycrome Road, Chesham, Buckinghamshire HP5 3LD (GB)

( * ) Notice: Subject to any disclaimer, the term of this patent is extended or adjusted under 35 U.S.C. 154(b) by 0 days.

(21) Appl. No.: 09/509,528

(22) PCT Filed: Sep. 16, 1998

(86) PCT No.: PCT/GB98/02813

§ 371 Date: Mar. 31, 2000

§ 102(e) Date: Mar. 31, 2000

(87) PCT Pub. No.: WO99/17629

PCT Pub. Date: Apr. 15, 1999

(30) Foreign Application Priority Data

Oct. 2, 1997 (GB) ..... 9720853
Nov. 11, 1997 (GB) ..... 9723682

(51) Int. Cl.[7] ..... A43C 17/00
(52) U.S. Cl. ..... 54/83.1

(58) Field of Search ..... 54/83.1, 83.2

(56) References Cited

U.S. PATENT DOCUMENTS 655,555 A * 8/1900 Jackson ..... 54/83.3

FOREIGN PATENT DOCUMENTS

DE 9414956 * 11/1994

* cited by examiner

*Primary Examiner*—Robert P. Swiatek
(74) *Attorney, Agent, or Firm*—Dennison, Scheiner & Schultz

(57) ABSTRACT

The present invention provides a spur assembly having a spur body (2) and a spur bit (20). The spur body provides a plurality of spur bit locations (12, 14). Such that the location of the spur bit (20) relative to the spur body (2) may be varied. A further aspect of the invention relates to a new method of interattaching the spur bit (20) and the spur body (2), such that a variety of different spur bits (20) may be used with the same spur body (2).

15 Claims, 3 Drawing Sheets

SPURS

FIELD OF THE INVENTION

The present invention relates to spur assemblies for use primarily but not exclusively in the control of horses.

BACKGROUND OF THE INVENTION

Spur assemblies commonly comprise a spur body for attaching the assembly to a shoe or boot of the rider and a spur bit attached to the spur body, which spur bit is the part of the spur used to control the horse.

A traditional spur body comprises a generally U-shaped configuration which fits around the heel of the riders boot. Each arm of the body has a cut out section at the end thereof through which a strap, generally leather or nylon is fed. The strap can be fastened around the foot section of the boot, thus providing a means of removably attaching the spur to the boot. The traditional spur body further comprises a projection extending perpendicularly from the middle of the outer surface of the curved section of the spur body. This projection generally accommodates the spur bit in some manner. Usually, the spur bit is fixedly attached to the spur body.

German Offenlegungschrift number DE 2,840,821 discloses various means of attaching spur bits to the projection of a traditional spur body. In one embodiment, serrated surfaces on the spur bit and the interior of a cavity of the projection interlock to attach the spur bit to the spur body and prevent accidental removal of the spur bit. A longitudinal cut away section of the shank of the spur bit in the region of the serrations allows for removal of the spur bit from the spur body by squeezing opposite sides of the shank together such as to close the cut away section and thus release the interlocked serrations.

Another embodiment of DE 2,840,821 comprises a spur bit having a shank which can be screwed into a cavity of the projection of the spur body and is thus removably attached to the spur body. A further embodiment comprises a plate which wraps around the outer surface of the projection of the spur body and is rotatably mounted on the projection. The plate comprises a pin which when the spur bit is located in the cavity of the projection extends through the projection and through the shank of the spur bit to removably attach the spur bit to the spur body.

French patent application number 2,633,494 discloses a traditional spur body wherein the shank of the spur bit comprises a hole which, when the shank is located in the cavity of the projection, corresponds with a hole in the projection. A plate is applied to the outer surface of the projection, which plate comprises a pin extending through the hole in the projection and the hole in the shank so as to attach the spur bit to the spur body. The plate is held in position by means of a screw which passes into a second hole in the projection. Hence, the spur bit is removably attached to the spur body.

French patent application number 2,681,222 discloses the removable attachment of a spur bit to a spur body by means of a slidable arrangement. A projection of the spur bit corresponds with a projection on the spur body and is slidably contactable therewith. A corresponding hole passing through each projection allows the spur bit to be removably attached to the spur body by means of a separate screw.

An alternative spur assembly involves attachment of a spur bit directly to a receiving means in the heel of the riders shoe or boot. In this case, the spur body is effectively the receiving means of the heel of the boot or shoe. FR 2,681,222 discloses that the projection of the spur body could be located directly on the heel of the riders boot. Furthermore, U.S. Pat. No. 4,642,910 discloses a spur bit comprising a cut away section extending along the length of the shank thereof and a spring arm attached to the distal end of the cut away section and extending longitudinally therealong. The cut away section of the shank is inserted into a cavity in the heel of the riders boot or shoe and is removably held in place by means of the spring arm.

It is desirable to provide for interchangeable spur bits which can be removably attached to the same spur body. However, the prior art spur assemblies as referred to above are both complicated to manufacture and to use. It is an aim of preferred embodiments of the present invention to provide a spur assembly comprising interchangeable spur bits which is simple both to manufacture and to use.

All prior art assemblies comprise a single fixed location for attachment of the spur bit to the spur body. It is a further aim of preferred embodiments of the invention to provide a spur assembly which allows for variation in the positionings of the spur bit relative to the spur body.

SUMMARY OF THE INVENTION

According to a first aspect of the invention, there is provided a spur assembly comprising a spur body and a spur bit, wherein the spur body comprises a plurality of spur bit locations.

Suitably, a first spur bit location is spaced from a second spur bit location.

Preferably the spur body comprises a U-shaped configuration. Suitably, the spur bit locations are provided by cavities in the spur body. Such cavities are suitably located in the curved section of the spur body with openings on the exterior thereof. Advantageously, a first cavity is situated in the middle of the curved section of the U-shaped body and a second cavity is situated at a location spaced from the first cavity.

Suitably, a cover plate is associated with the spur body. The cover plate is operable to cover the vacant cavity or cavities. The cover plate is preferably slidably mounted of the spur body. Suitably, the cover plate has a ridged exterior surface to facilitate movement of the plate. Suitably, the cover plate is set into the surface of the spur body. If the cover plate comprises surface ridges and is set into the surface of the spur body, the ridges preferably protrude beyond the surface of the spur body.

Suitably, a first spur bit location is rotatably different relative to a second spur bit location position. Suitably, a spur bit comprises a shank capable of fitting in a cavity in the spur body in a plurality of rotatably different position. Suitably, the shank is of a regular shape corresponding to the cavity. Both rotatably different and spaced spur bit locations may be provided.

A second aspect of the present invention further provides a spur assembly, comprising a spur body and a spur bit, said spur body comprising a cavity in which a shank portion of said spur bit is retained, the cross-section of a portion of said shank being polygonal and corresponding to the cross-section of a corresponding portion of said cavity, said shank further comprising a groove in which an O-ring is located and said cavity further comprising a section of circular cross-section corresponding to the location of the O-ring of the shank when said shank is located in said cavity.

Preferably, the polygonal portion of the shank of the spur bit is located at the distal end of the shank. The cross section of the shank and corresponding portion of the cavity are suitably hexagonal. However, any cross-section suitable for preventing rotation of said shank within said cavity is acceptable.

The O-ring may be comprised of any suitable material such as, rubber or nylon. The O-ring when located within the groove of the shank preferably sits proud of the surrounding shank. When the shank is inserted into the cavity the compression force arising between the O-ring and the surrounding cavity wall causes the shank to be held firmly in the cavity. To increase the compression force either the depth of the groove in which the O-ring is located may be reduced or the thickness of the O-ring may be increased such that the O-ring protrudes further outside the diameter of the shank when located in the groove.

In order to facilitate insertion of the shank into the cavity, the diameter of the cavity may taper outwards slightly in the region of the exterior surface of the spur body.

To the extent that they are not mutually exclusive, the features of the first and second embodiments of the present invention may be used in combination.

It is envisaged that the cavity in which the shank of the spur bit is retained may alternatively be located within the heel of a boot or shoe worn by the rider. In this case, the spur body would be provided by the heel of the riders' boot or shoe.

BRIEF DESCRIPTION OF THE DRAWINGS

The present invention will now be described, by way of example only, with reference to the accompanying drawings, in which.

DESCRIPTION OF THE PREFERRED EMBODIMENTS

Figure 1:
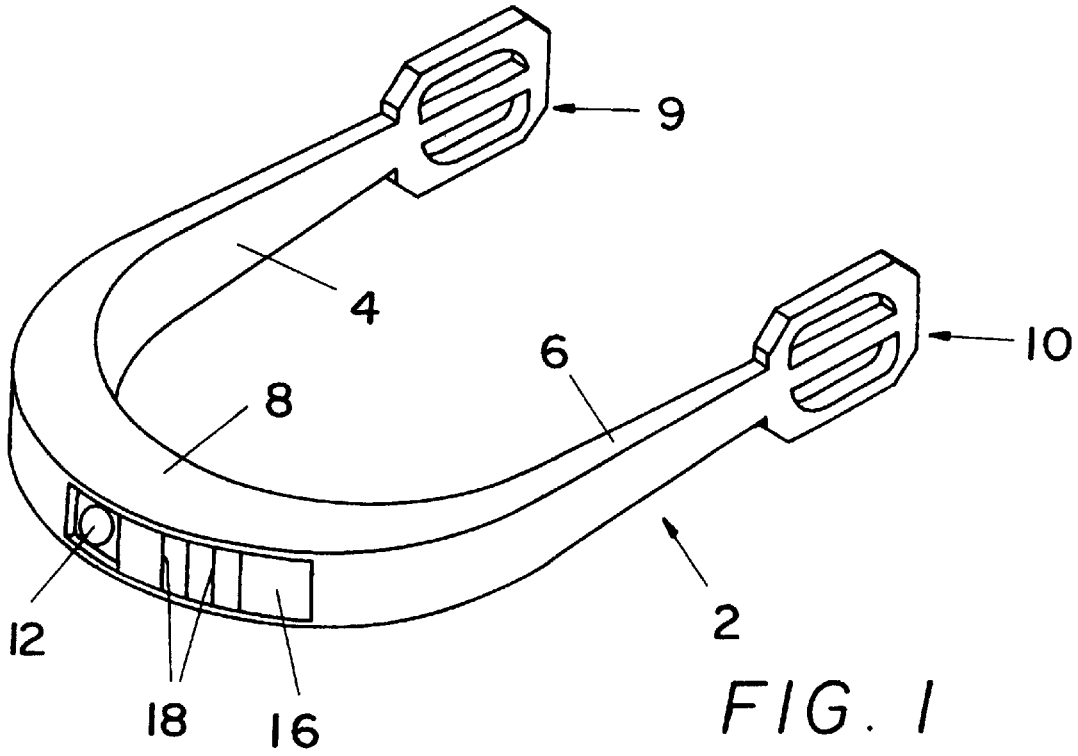
FIG. 1 illustrates a perspective view of a spur body in accordance with first and/or second aspects of the invention.

FIG. 1 illustrates a spur body (2) of U-shaped configuration comprising two arms (4, 6), and a curved section (8). Each arm (4, 6) comprises a cut away section (9, 10) at each distal end thereof through which a strap (not shown) may be threaded, the strap being suitable for use in affixing the spur body (2) to the boot of a rider (not shown).

Figure 2:
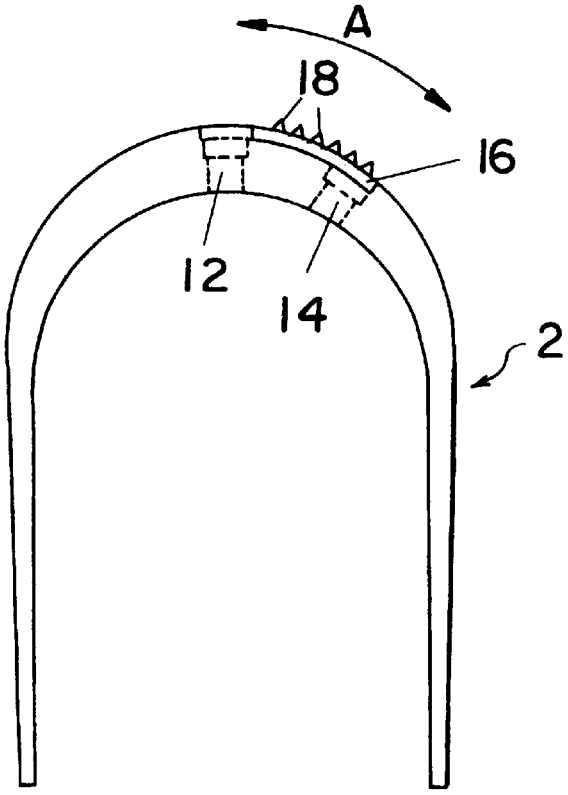
FIG. 2 illustrates a plan view of the spur body of FIG. 1.

The body (2) further comprises a first cavity (12) and a second cavity (14) (see FIG. 2). A cover plate (16) is slidably mounted of said body (2) and is set into the exterior surface of the curved section (8) of the body (2), such that the outer surface of said cover plate (16) is flush with the outer surface of the curved section (8). Cover plate (16) comprises a plurality of ridges (18) which protrude from the surface thereof. As a result of the cover plate (16) being set into the outer surface of the curved section (8), the end of the cavity (12) opening out onto the exterior surface of the curved section (8) is also set into the exterior surface of the curved section (8).

FIG. 2 shows a plan view of the spur body of FIG. 1. The relative locations of the cavities (12, 14) are illustrated by dotted lines.

Figure 3:
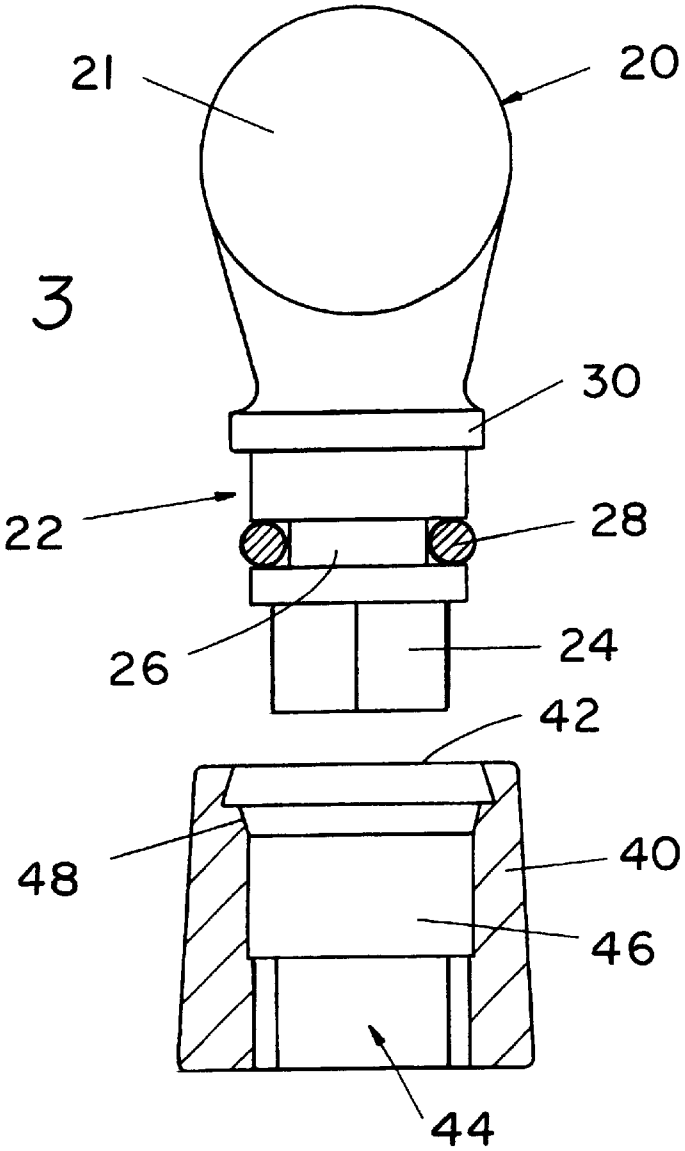
FIG. 3 illustrates a cross-sectional elevation of a cavity and shank of a spur assembly in accordance with the first and/or second aspects of the invention.

FIG. 3 illustrates a spur bit (20) and a cavity (12). The spur bit (20) has a head (21) and a shank (22), which shank (22) comprises a regular hexagonal section (24) and a circumferential groove (26). A rubber O-ring (28) is situated in the groove (26). The depth of the groove (26) and the thickness of the O-ring (28) are such that the O-ring (28) protrudes from the surface of the shank (22). The spur bit further comprises a section of square cross-section (30), which square section (30) provides an acceptable appearance at the exterior interface of the spur bit (20) and the spur body (2).

FIG. 3 further illustrates a portion of a spur body (40) comprising a cavity (42). The cavity (42) comprises a hexagonal section (44), which hexagonal section (44) corresponds with the hexagonal section (24) of the spur bit (20). A section of the cavity (42) of circular cross-section (46) corresponds to the section of the shank (22) in which the groove (26) and O-ring (28) are located. The opening of the cavity (42) at the outer surface of the spur body (40) is tapered (48) to facilitate insertion and removal of shank (22) into and from cavity (42).

Figure 4:
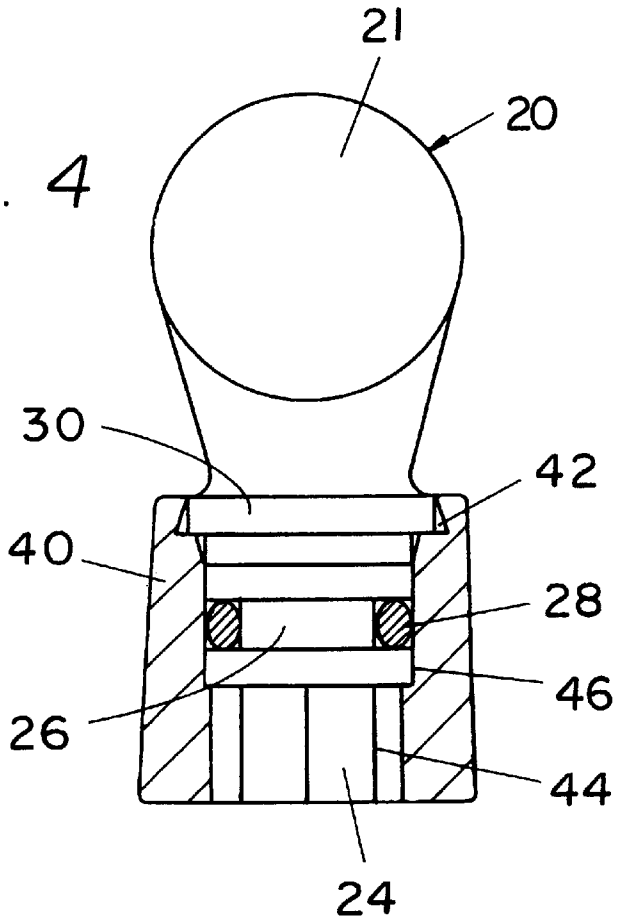
FIG. 4 illustrates a cross-sectional elevation of the cavity and shank of FIG. 3 when interconnected.

FIG. 4 illustrates the spur bit (20) and cavity (42) of FIG. 3 when the spur bit (20) is located in cavity (42). As can be seen from FIG. 4, when the shank (22) of the spur bit (20) is located in the cavity (42) of the spur body (40), the O-ring (28) is compressed between the groove (26) and the circular cross-sectional section (46) of the cavity (42). The compression force thus generated by way of a compression fit maintains the spur bit (20) in contact with the spur body (40). To remove the spur bit (20) from the spur body (40), the spur bit (20) should be pulled firmly from the cavity (42) with sufficient force to overcome the compression force.

In use of the spur assembly of FIGS. 1 to 4, the shank (22) of the spur bit (20) can be located in either of the cavities (12, 14). The cover plate (16) can be slid in the directions indicated by arrow A such that either the first cavity (12) or the second cavity (14) are exposed. Thus, when a spur bit (20) is located in the first cavity (12) the cover plate (16) will cover the second cavity (14) and vice versa.

Figure 5:
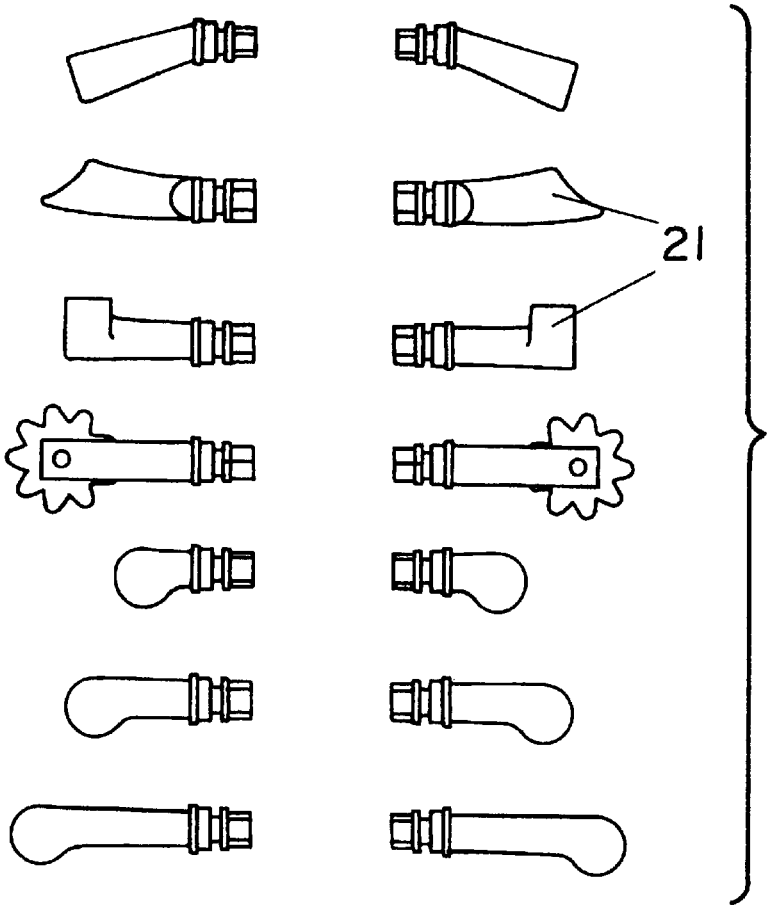
FIG. 5 illustrates a selection of alternative spur bit designs.

FIG. 5 illustrates an assortment of spur bit designs having different spur head (21) configurations. Such a selection of spur bits could be utilised in conjunction with the present invention. Hence, a variety of different spur bits can be used in conjunction with the same spur body.

Figure 6:
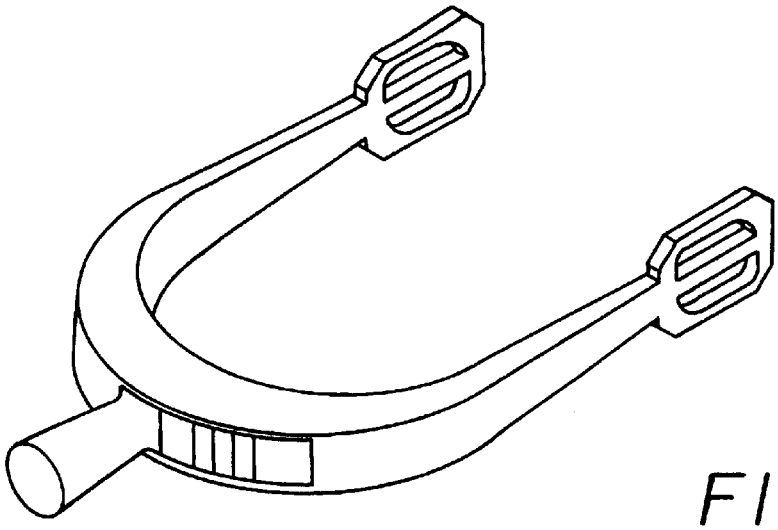
FIG. 6 illustrates a spur bit located in a first spur location position in a spur body.

FIG. 6 shows a spur bit (20) in a first spur bit location position in a spur body (2).

In use a spur bit (20) can, therefore, be located in one of two spaced cavities (12, 14) and within each cavity (12, 14) each spur bit (20) can be located in a plurality of rotatably different positions. For curved or other non-circular symmetrical spur bits this provides a wide variety of choice of positioning to enable spur location to suit both horse and rider.

It is noted that the present invention is not limited to two spaced locations as other may be envisaged.

It is further noted that the present design ensures the back of the spur assembly does not include any unsightly bulges.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A spur assembly comprising a spur body and a spur bit, said spur body including a plurality of spur bit locations, and a cover plate associated with said spur body, wherein said cover plate is operable to cover vacant spur bit locations.

2. A spur assembly comprising a spur body and a spur bit, said spur body including a plurality of spur bit locations, and a cover plate, wherein said cover plate is slidably mounted on said spur body.

3. A spur assembly comprising a spur body and a spur bit, said spur body including a plurality of spur bit locations, and a cover plate disposed on said spur body, wherein said cover plate has a ridged exterior surface.

4. A spur assembly comprising a spur body and a spur bit, said spur body including a plurality of spur bit locations, and a cover plate, wherein said cover plate is set into the surface of said spur body.

5. A spur assembly comprising a spur body and a spur bit, said spur body comprising a cavity in which a shank portion of said spur bit is retained, the cross-section of a portion of said shank being polygonal and corresponding to the cross-section of a corresponding portion of said cavity, said shank further comprising a groove in which an O-ring is located and said cavity further comprising a section of circular cross-section corresponding to the location of said O-ring of said shank when said shank is located in said cavity.

6. A spur assembly in accordance with claim 5, wherein said polygonal portion of said shank is located at the distal end of said shank.

7. A spur assembly in accordance with claim 6, wherein said polygonal cross-section is a hexagonal cross-section.

8. A spur assembly in accordance with claim 5, wherein said shank is held in said cavity by a compression force arising between said O-ring and said surrounding cavity wall.

9. A spur assembly in according to claim 5, wherein said cavity tapers outwards in the region of the exterior surface of said spur body.

10. A spur assembly according to claim 5 including an opening for receiving a shank portion of a spur bit.

11. A spur assembly according to claim 10 wherein said opening is spaced apart from said cavity.

12. A spur assembly according to claim 5 wherein said spur body has a U-shaped configuration.

13. A spur assembly according to claim 5 wherein said spur body has a U-shaped configuration including a bight and wherein said cavity and said opening are located in said bight.

14. A spur assembly according to claim 13 wherein said cavity is located in the middle of said bight.

15. A spur assembly according to claim 5 including a cover plate associated with said spur body.

* * * * *